US011022412B2

(12) United States Patent
Morris

(10) Patent No.: US 11,022,412 B2
(45) **Date of Patent: *Jun. 1, 2021**

(54) MORRIS 80 PLASTIC APOLLO BOLT

(71) Applicant: Elgie Allen Morris, Grants Pass, OR (US)

(72) Inventor: Elgie Allen Morris, Grants Pass, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/355,725

(22) Filed: Mar. 16, 2019

(65) Prior Publication Data

US 2021/0131775 A1 May 6, 2021

(51) Int. Cl.
*F42B 6/06* (2006.01)
*F42B 10/04* (2006.01)
*F42B 6/04* (2006.01)

(52) U.S. Cl.
CPC ..... *F42B 6/06* (2013.01); *F42B 6/04* (2013.01); *F42B 10/04* (2013.01)

(58) Field of Classification Search
CPC ..... F42B 6/04; F42B 6/06; F42B 6/08
See application file for complete search history.

(56) References Cited

U.S. PATENT DOCUMENTS 3,031,797 A * 5/1962 Gelfand ..... A63H 27/14 446/65
3,106,400 A * 10/1963 Zwickey ..... F42B 6/06 473/586
3,756,602 A * 9/1973 Carella ..... F42B 6/06 473/586

(Continued)

*Primary Examiner* — John A Ricci

(57) ABSTRACT

When combined with a metal point, this ten inch plastic pistol crossbow bolt is designed to extend past the barrel of a pistol crossbow so it can be used for small game hunting, pistol crossbow fishing, recreational shooting and competition shooting. The major fault of the standard bolt commonly used with a pistol crossbow is, they are less than seven inches in length and do not extend past the end of a pistol crossbow barrel. Therefore, their use is limited to target points and recreational shooting only. Other faults of the standard short bolts are their high travel speed. They are very difficult to be viewed in flight, causing most bolts to be lost after one use. Also, because of their irretrievability from any commonly used target, they cannot be found and scored in any type of shooting competition. This ten inch bolt is a solid one piece unit made of a strong but, light weight plastic compound. It has a NOCK to securely hold the bow string in place. Standard pistol crossbow bolts do not have a nock. It has two ROUNDED WINGS and a stabilizing TAIL which creates an accurate and stable bolt flight. No other pistol crossbow bolt has rounded wings and a tail. These features allow this bolt to be easily viewed in flight. The shaft has a THREADED TIP to accept almost any type metal point. The major advantage of this new bolt over other patented bolts of this size is the rounded wings. The rounded wings gives this bolt added body weight. This added body weight requires additional point weight to balance with that heavier body weight. This heavier bolt body gives this bolt the added weight needed for knock-down power in small game hunting and, the necessary added weight for better water penetration when used for pistol crossbow fishing.

1 Claim, 5 Drawing Sheets

(56) References Cited

U.S. PATENT DOCUMENTS

| | | | | | |
|---|---|---|---|---|---|
| 3,846,878 | A * | 11/1974 | Monson | F42B 6/04 | 86/51 |
| 3,851,590 | A * | 12/1974 | LaCosta | F42B 6/04 | 102/501 |
| 3,853,320 | A * | 12/1974 | Carella | F42B 6/06 | 473/586 |
| 3,861,314 | A * | 1/1975 | Barr | F42B 6/04 | 102/501 |
| 4,003,576 | A * | 1/1977 | Carella | F42B 6/06 | 473/586 |
| 4,182,513 | A * | 1/1980 | Henderson | F42B 6/04 | 124/24.1 |
| 4,696,281 | A * | 9/1987 | Nishioka | F42B 6/00 | 124/25 |
| 6,695,727 | B1 * | 2/2004 | Kuhn | F42B 6/06 | 473/586 |
| 8,157,680 | B2 * | 4/2012 | Anderson | F42B 6/04 | 473/578 |
| 8,764,589 | B1 * | 7/2014 | Thompson | F42B 6/04 | 473/578 |
| 10,209,043 | B2 * | 2/2019 | Morris | F42B 6/06 | |
| 2013/0123051 | A1 * | 5/2013 | Pierce | F42B 6/08 | 473/577 |

* cited by examiner

MORRIS 80 PLASTIC APOLLO BOLT

RELATED APPLICATIONS

Provisional Application No. 62/419,431
Filing Date: Nov. 8, 2016

STATEMENT REGARDED FEDERALLY SPONSORED RESEARCH

Not Applicable

NAMES OF PARTIES IN JOINT RESEARCH AGREEMENT

Not Applicable

INCORPORATION-BY-REFERENCE OF MATERIAL

Not Applicable

STATEMENT REGARDING PRIOR DISCLOSURES BY INVENTOR OR JOINT INVENTOR

Not Applicable

BACKGROUND

This plastic pistol crossbow bolt is made for the fifty to eighty pound pistol crossbows. It is nine and one quarter inches in length with a threaded tip to receive a metal point. Total length of this bolt will depend on the length of any metal point used. This new bolt solves many problems often found with the restricted uses of the bolts commonly used with pistol crossbows.

The commonly used pistol crossbow bolts are about six inches in length. Those short bolts cause lack of visibility during flight, difficulty in locating upon impact and irretrievability of those short bolts after impact into any standard target. For that reason, those short pistol crossbow bolts cannot be used for any tournament competition, small game hunting, pistol crossbow fishing or pistol crossbow scuba fishing. The MORRIS 80 PLASTIC APOLLO BOLT solves those problems.

Any pistol crossbow bolts, made of metal and designed with sufficient length to solve some of the above stated problems, require some type of fetches be attached to those bolts for stability during flight. During use, those fletches often becomes loosened and requires constant reattachment and repair. That becomes is a major problem with the metal pistol crossbow bolts. The MORRIS 80 PLASTIC APOLLO BOLT is a one piece solid plastic unit including two wings and a tail for stabilization. It does not require added fletches be glued into place or continued reattachment of fletches.

SUMMARY

A plastic pistol crossbow bolt created by injection mold. Bolt composition is durable plastic with nylon reinforcement. Bolt is nine and one quarter inches in length. Bolt is designed with two wings to stabilize bolt elevation and a tail to stabilize directional flight. Bolt has a threaded tip designed to extend past the barrel end and, use a variety of metal points included target, hunting, fishing and field points. No other pistol crossbow bolt is designed with two rounded wings and a tail and, use this variety of points. This plastic pistol crossbow bolt, with its extended length, unique design and versatility in point usage, is designed to totally change and enhance the way any pistol crossbow is used.

DESCRIPTION

DETAILED DESCRIPTION

Figure 1:
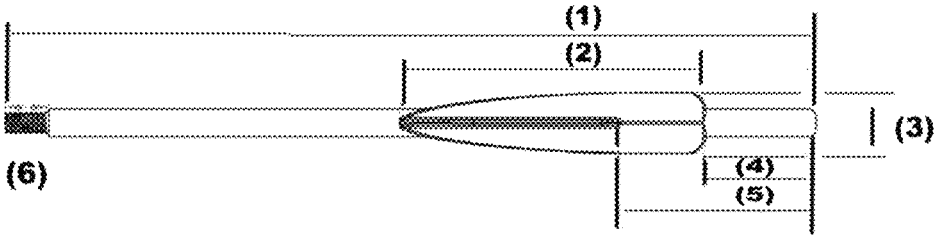
FIG. 1 shows the pistol crossbow bolt of the present invention viewed from above.

FIG. 1 shows the pistol crossbow bolt (1) is nine and one quarter inches in length. The bolt is a solid durable light weight plastic with nylon reinforcement. Bolt includes two rounded wings, (2), a shaft and a threaded tip (6) to receive a variety of metal points. Each wing (3) is tapered from five-sixteenths of an inch width down to approximately one-sixteenth of an inch width starting three-quarters of an inch (4) from the nock end down the length of the five inch wing. The tail starts two and three sixteenths of an inch from the nock end (5).

Figure 2:
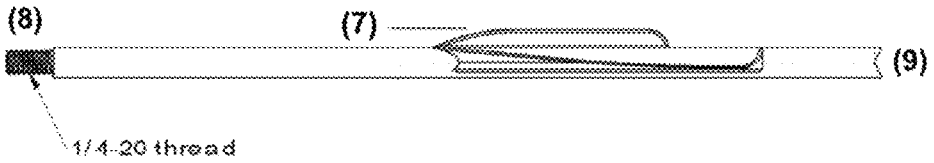
FIG. 2 shows the pistol crossbow bolt of the present invention viewed from side.
Figure 3:
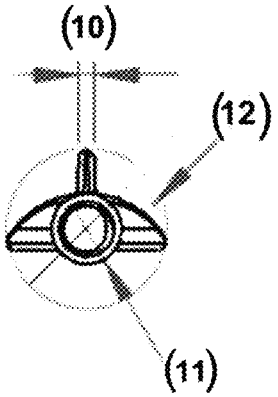
FIG. 3 shows the pistol crossbow bolt of the present invention viewed from tip end.
Figure 4:
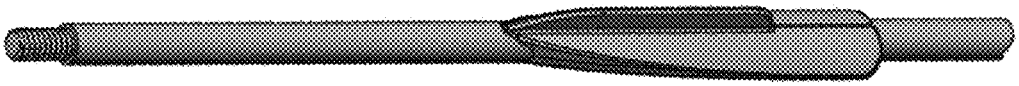
FIG. 4 shows a three dimensional view of the pistol crossbow bolt of the present invention.
Figure 5:
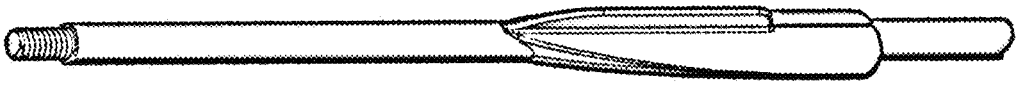
FIG. 5 shows a three dimensional line drawing of this invention viewed from above.

FIG. 2 shows the tail (7) is three and one half inches long. The tail is three-sixteenths of an inch tall and tapered down on each end. It shows a treaded tip on one end (8) and the nock (9) on the other end. FIG. 3 shows the tail (10) is one-sixteenth of an inch thick. The bolt shaft (11) is five-sixteenths of an inch in diameter and is dowel shaped. Each of the two side wings are rounded (12) and becomes level with the top of the shaft.

The invention claimed is:

1. A plastic pistol crossbow bolt designed for use with a pistol crossbow having a barrel, comprising: a shaft comprising a solid one piece injection molded plastic unit having a length of approximately nine and one half inches with a nock on a first end which is configured to securely hold a string of a pistol crossbow; two rounded wings which becomes level with an upper surface of the shaft to control elevation during bolt flight; a single stabilizing tail projecting upward from said upper surface along a diametrical line of the shaft to stabilize vertical flight; and a threaded end piece on a second end configured to accommodate a variety of steel points.

* * * * *